US010036286B2

(12) United States Patent
Camilo et al.

(10) Patent No.: US 10,036,286 B2
(45) Date of Patent: Jul. 31, 2018

(54) CHECK VALVE PLATE POSITIONER FOR CAMSHAFT PHASER

(71) Applicant: Schaeffler Technologies AG & Co. KG, Herzogenaurach (DE)

(72) Inventors: Alexandre Camilo, Rochester Hills, MI (US); Renato De Oliveira Ghiraldi, Sterling Heights, MI (US); Peter Cantin, Harrison Township, MI (US)

(73) Assignee: Schaffler Technologies AG & Co. KG, Herzogenaurach (DE)

( * ) Notice: Subject to any disclaimer, the term of this patent is extended or adjusted under 35 U.S.C. 154(b) by 116 days.

(21) Appl. No.: 15/297,531

(22) Filed: Oct. 19, 2016

(65) Prior Publication Data

US 2018/0106167 A1 Apr. 19, 2018

(51) Int. Cl.

| | |
|---|---|
| ***F01L 1/344*** | (2006.01) |
| ***F01L 1/047*** | (2006.01) |
| *F01L 1/46* | (2006.01) |

(52) U.S. Cl.

CPC ..... *F01L 1/3442* (2013.01); *F01L 1/047* (2013.01); *F01L 1/46* (2013.01); *F01L 2001/34433* (2013.01); *F01L 2001/34453* (2013.01); *F01L 2001/34469* (2013.01); *F01L 2001/34479* (2013.01)

(58) Field of Classification Search

CPC ... F01L 2001/34426; F01L 2001/34433; F01L 2001/34453; F01L 2001/34469; F01L 2001/34479; F01L 1/46

USPC ..... 123/90.17

See application file for complete search history.

(56) References Cited

U.S. PATENT DOCUMENTS

| | | | |
|---|---|---|---|
| 6,705,260 B2 | 3/2004 | Lewis et al. | |
| 2016/0169060 A1* | 6/2016 | Fischer | F01L 1/3442 123/90.17 |

FOREIGN PATENT DOCUMENTS

| | | |
|---|---|---|
| EP | 1357263 A2 | 10/2003 |

* cited by examiner

*Primary Examiner* — Jorge Leon, Jr.

(57) ABSTRACT

A camshaft phaser, including: an axis of rotation; a stator including a radially outermost surface with a plurality of teeth; a locking plate including a first side facing in a first axial direction, a bore in the first side, and a through-bore; a check valve plate axially located between the locking plate and the stator and including a through-bore and a displaceable valve flap aligned, in the first axial direction, with the through-bore for the locking plate; and a bushing disposed in the bore in the first side and in the through-bore for the check valve plate. The bushing extends past the locking plate in the first axial direction.

20 Claims, 12 Drawing Sheets

CHECK VALVE PLATE POSITIONER FOR CAMSHAFT PHASER

TECHNICAL FIELD

The present disclosure relates to a camshaft phaser, in particular a camshaft phaser with a bushing arranged to hold a check valve plate in position with respect to a locking plate.

BACKGROUND

FIG. 12 is a partial cross-sectional view of prior art camshaft phaser 200. FIG. 13 is a partial perspective view of a portion of the locking plate, check valve plate and bushing in FIG. 12. Camshaft phaser 200 includes: stator 202 with teeth 204; rotor 206; locking plate 208; check valve plate 210; bushing 212; and swing cover 214. Timing chamber 216 is bounded, at least in part, by stator 202, rotor 206 and check valve plate 210. Space 218 is bounded, at least in part, by locking plate 208 and spring cover 214.

For fluid pressure in space 218 greater than fluid pressure in chamber 216, fluid in space 218 is arranged to displace flap 220 of plate 210 in axial direction AD1 so that through-bore 222 in plate 208, which is open to space 218, is open to chamber 216. Thus, fluid from space 218 flows to chamber 216 through through-bore 222. For fluid pressure in chamber 216 greater than fluid pressure in space 218, fluid in chamber 216 is arranged to displace flap 220 in axial direction AD2, opposite direction AD1, so that through-bore 222 is blocked by flap 220. Thus, fluid cannot flow from chamber 216 to space 218 through bore 222.

During assembly of phaser 200, plates 208 and 210 are placed together in a desired orientation (for example so that flaps 220 cover through-bores 222). Plates 208 and 210 must remain in this orientation during the remaining assembly steps for phaser 200, for example, the fastening of cover plate 224, plate 210 and plate 208 together. However, as shown in FIG. 13, plate 210 overlaps bushing 212, for example, line L in direction AD1 passes through bushing 212 and plate 210. Thus, there is no feature on plate 208 or bushing 212 that holds plate 210 in position with respect to plate 208. Extra steps, which are not always successful, must be taken to maintain the desired orientation of plates 208 and 210. These extra steps increase the complexity and cost of assembling.

SUMMARY

According to aspects illustrated herein, there is provided a camshaft phaser, including: an axis of rotation; a stator including a radially outermost surface with a plurality of teeth; a locking plate including a first side facing in a first axial direction, a bore in the first side, and a through-bore; a check valve plate axially located between the locking plate and the stator and including a through-bore and a displaceable valve flap aligned, in the first axial direction, with the through-bore for the locking plate; and a bushing disposed in the bore in the first side and in the through-bore for the check valve plate. The bushing extends past the locking plate in the first axial direction.

According to aspects illustrated herein, there is provided a camshaft phaser, including: an axis of rotation; a stator including a radially outermost surface with a plurality of teeth; a locking plate including a first side facing in a first axial direction, a bore in the first side, and a through-bore; a check valve plate axially located between the locking plate and the stator and including a through-bore and a displaceable valve flap aligned, in the first axial direction, with the through-bore for the locking plate; and a bushing. The bushing includes a longitudinal axis extending in the first axial direction and is disposed in the bore in the first side and in the through-bore for the check valve plate. The bushing blocks movement of the check valve plate, with respect to the locking plate, in a radial direction with respect to the longitudinal axis or in a circumferential direction with respect to the longitudinal axis.

According to aspects illustrated herein, there is provided a method of operating a camshaft phaser including an axis of rotation, a stator, a rotor, a locking plate, a check valve plate axially located between the locking plate and the stator, a chamber formed at least in part by the stator, the rotor and the check valve plate, and a bushing disposed in a bore in the locking plate and in a through-bore in the check valve plate, the method including: blocking a through-bore in the locking plate with a flap in the check valve plate; displacing, in a first axial direction parallel to the axis of rotation, the flap in the check valve plate; flowing fluid through the through-bore to the chamber; displacing, in a second axial direction opposite the first axial direction, the flap in the check valve plate; blocking, with the flap, flow of the fluid from the chamber through the through-bore; and blocking, with a bushing disposed in the locking plate and in the check valve plate, movement of the check valve plate with respect to the locking plate in a radial or circumferential direction as referenced by the axis of rotation.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1:
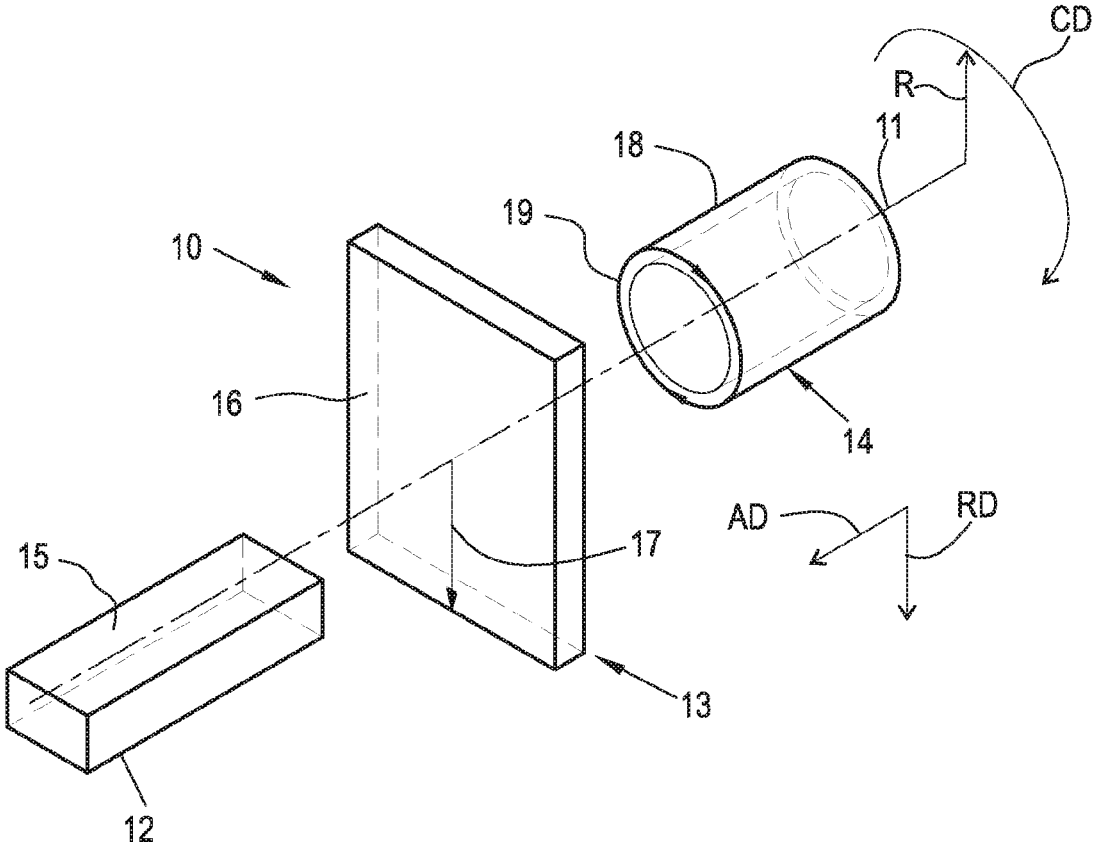
FIG. 1 is a perspective view of a cylindrical coordinate system demonstrating spatial terminology used in the present application.

FIG. 1 is a perspective view of cylindrical coordinate system 10 demonstrating spatial terminology used in the present application. The present application is at least partially described within the context of a cylindrical coordinate system. System 10 includes longitudinal axis 11, used as the reference for the directional and spatial terms that follow. Axial direction AD is parallel to axis 11. Radial direction RD is orthogonal to axis 11. Circumferential direction CD is defined by an endpoint of radius R (orthogonal to axis 11) rotated about axis 11.

To clarify the spatial terminology, objects 12, 13, and 14 are used. An axial surface, such as surface 15 of object 12, is formed by a plane co-planar with axis 11. Axis 11 passes through planar surface 15; however any planar surface co-planar with axis 11 is an axial surface. A radial surface, such as surface 16 of object 13, is formed by a plane orthogonal to axis 11 and co-planar with a radius, for example, radius 17. Radius 17 passes through planar surface 16; however any planar surface co-planar with radius 17 is a radial surface. Surface 18 of object 14 forms a circumferential, or cylindrical, surface. For example, circumference 19 is passes through surface 18. As a further example, axial movement is parallel to axis 11, radial movement is orthogonal to axis 11, and circumferential movement is parallel to circumference 19. Rotational movement is with respect to axis 11. The adverbs "axially," "radially," and "circumferentially" refer to orientations parallel to axis 11, radius 17, and circumference 19, respectively. For example, an axially disposed surface or edge extends in direction AD, a radially disposed surface or edge extends in direction R, and a circumferentially disposed surface or edge extends in direction CD.

Figure 2:
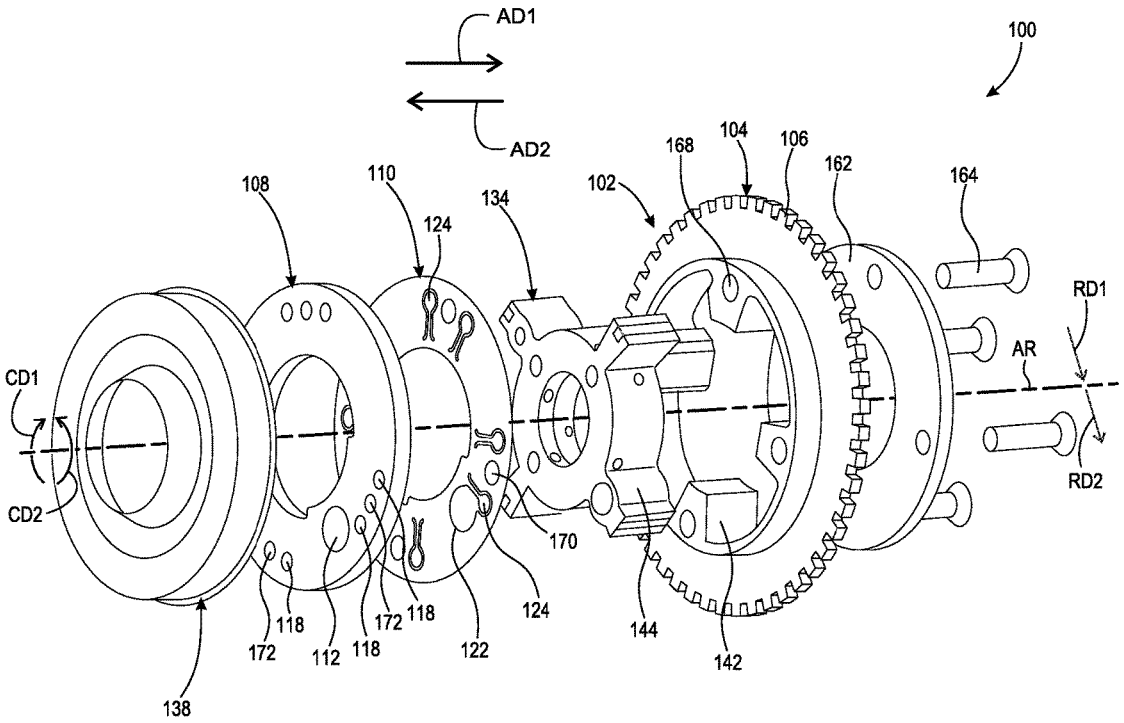
FIG. 2 is an exploded view of an example camshaft phaser with check valve plate positioning.

FIG. 2 is an exploded view of example camshaft phaser 100 with check valve plate positioning. Phaser 100 includes: axis of rotation AR; stator 102 including radially outermost surface 104 with teeth 106; locking plate 108; check valve plate 110; and bushing 112.

Figure 3:
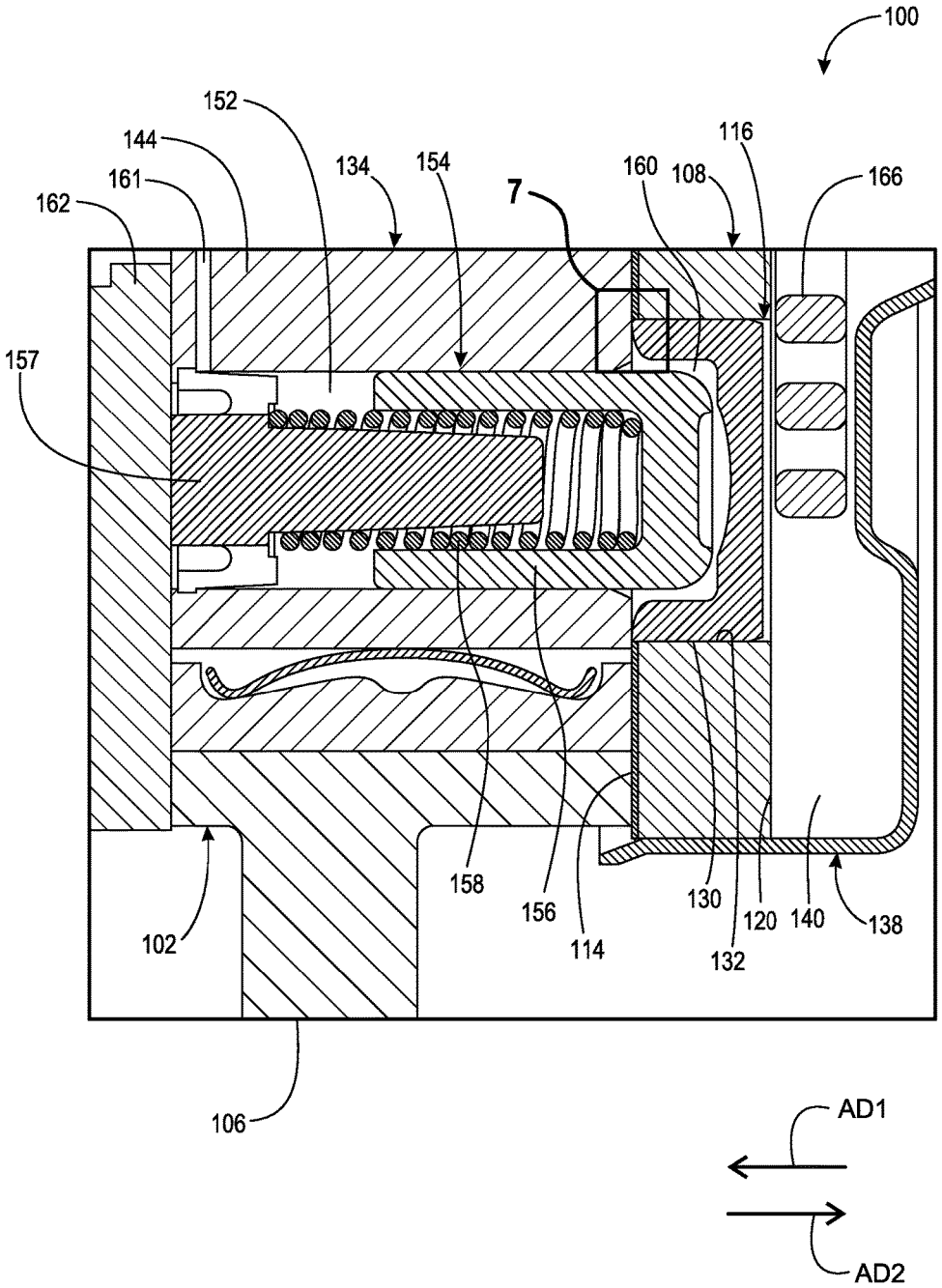
FIG. 3 is a partial cross-sectional view of the camshaft phaser in FIG. 2 through a vane in a rotor for the camshaft phaser.

FIG. 3 is a partial cross-sectional view of camshaft phaser 100 in FIG. 2.

Figure 4:
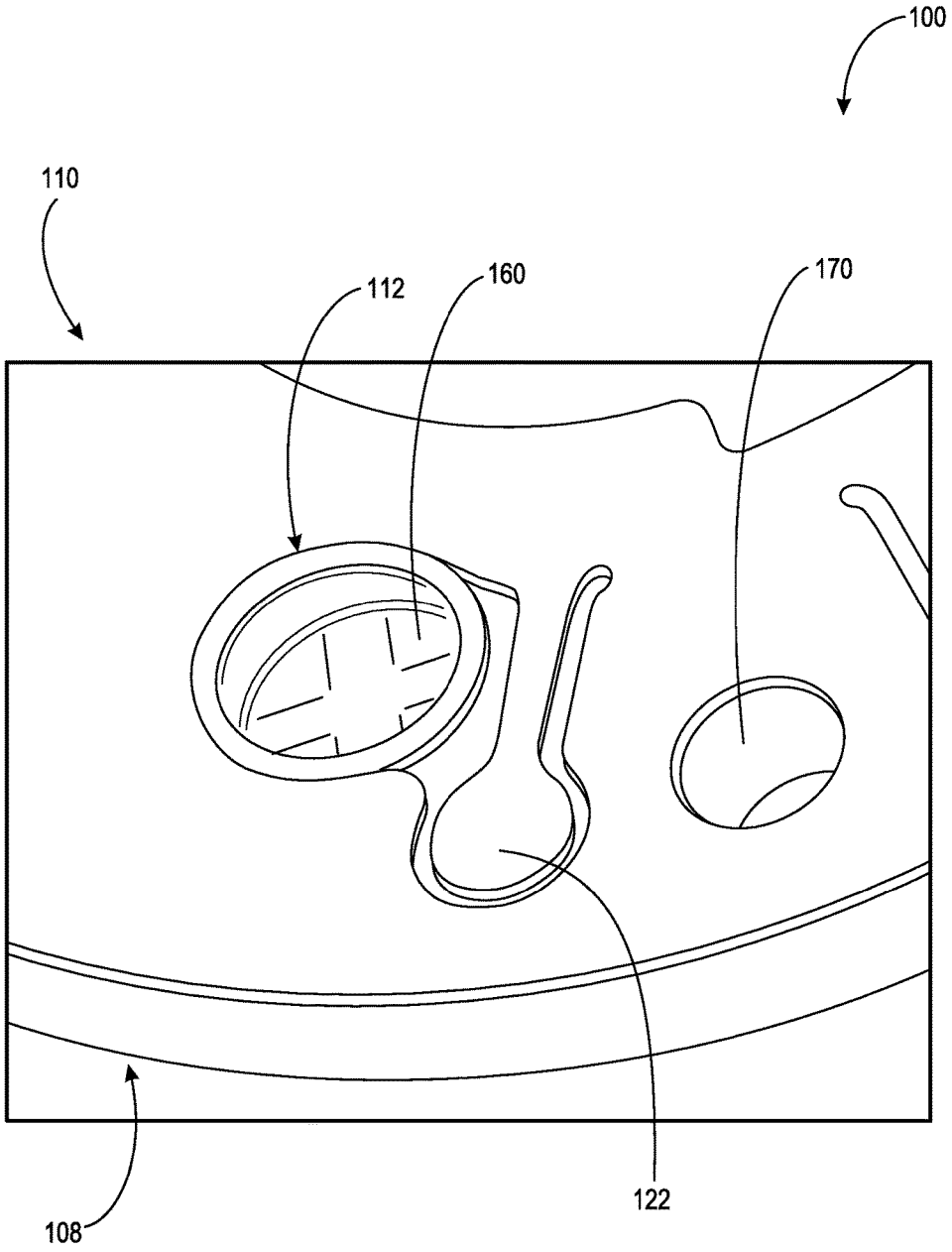
FIG. 4 is a perspective view of a portion of an example embodiment of the locking plate, check valve plate and bushing in FIG. 2.

FIG. 4 is a perspective view of a portion of an example embodiment of locking plate 108, check valve plate 110, and bushing 112 in FIG. 2.

Figure 5:
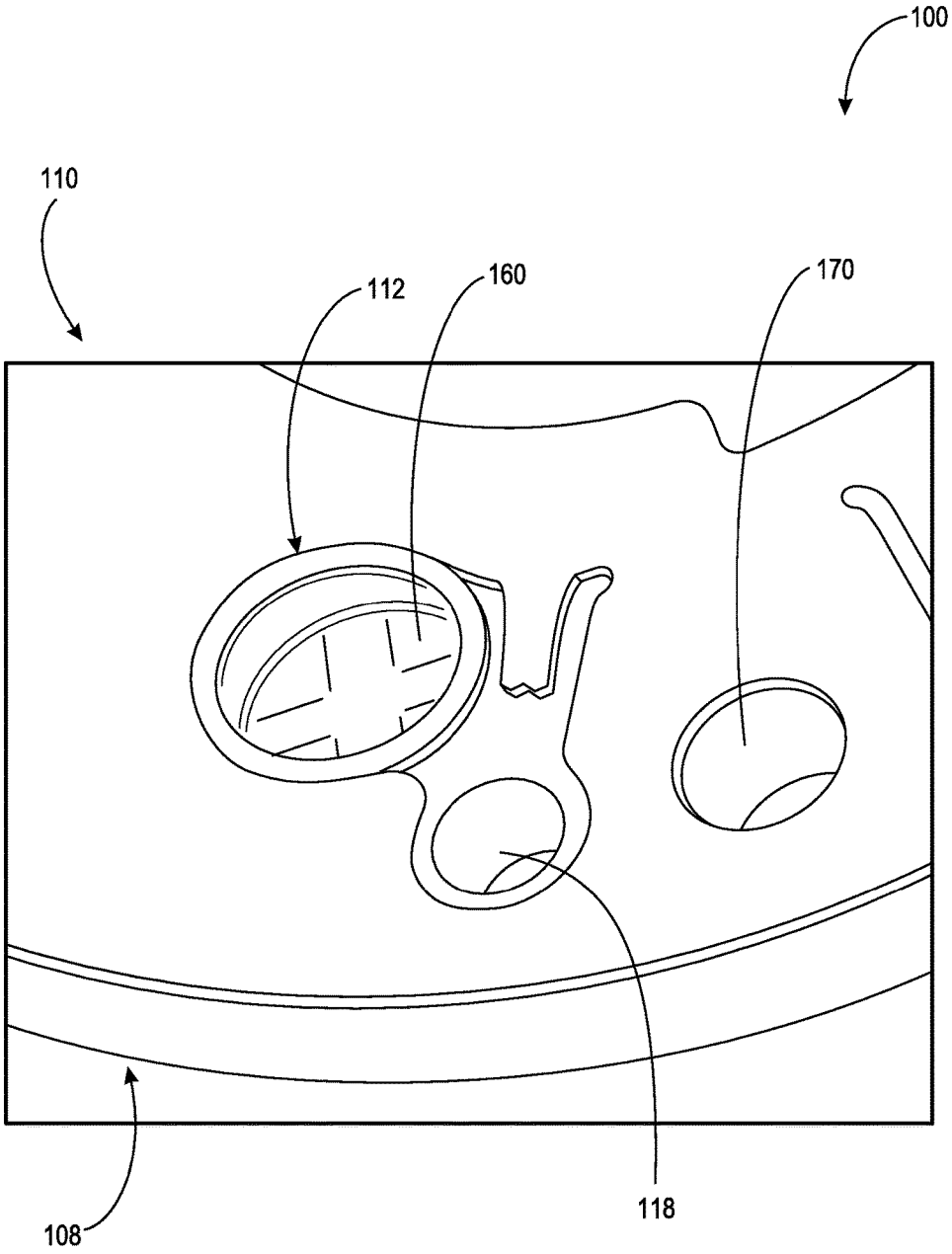
FIG. 5 is the perspective view of FIG. 4 with a portion of the valve flap removed to show a through-bore in the locking plate.

FIG. 5 is the perspective view of FIG. 4 with a portion of the valve flap removed to show a through-bore in the locking plate.

Figure 6:
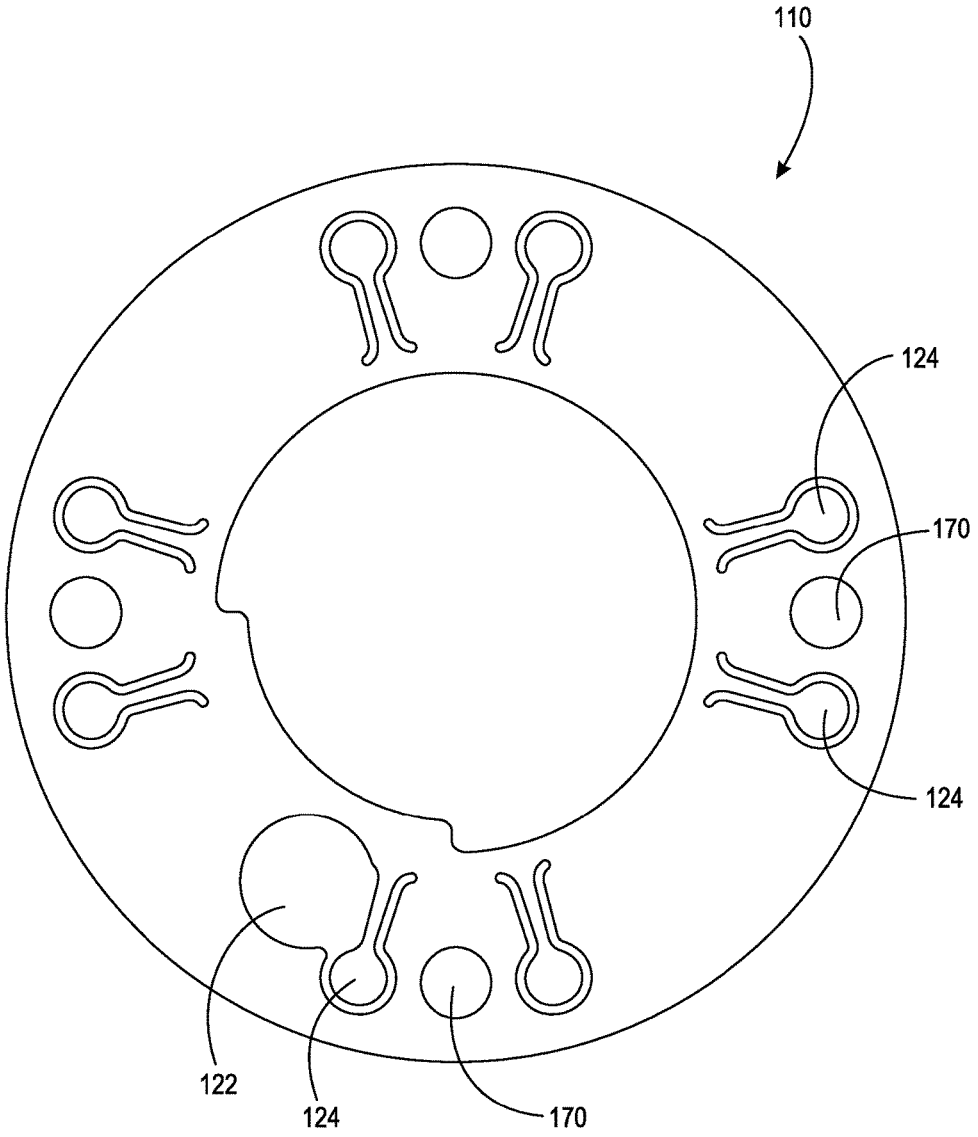
FIG. 6 is a front view of the check valve plate in FIG. 2.

FIG. 6 is a front view of check valve plate 110 in FIG. 2. The following should be viewed in light of FIGS. 2 and 6. Plate 108 includes: side 114 facing in axial direction AD1; bore 116 in side 114; and through-bores 118. By through-bore, we mean that through-bore 118 extends from side 114 to side 120 facing in axial direction AD2, opposite direction AD1. In an example embodiment, bore 116 is a through-bore. Check valve plate 110 is axially located between locking plate 108 and stator 102. Plate 110 includes through-bores 122 and displaceable valve flaps 124 aligned, in axial direction AD1, with through-bores 118. Bushing 112 is disposed in bore 116 and in through-bore 122.

Figure 7:
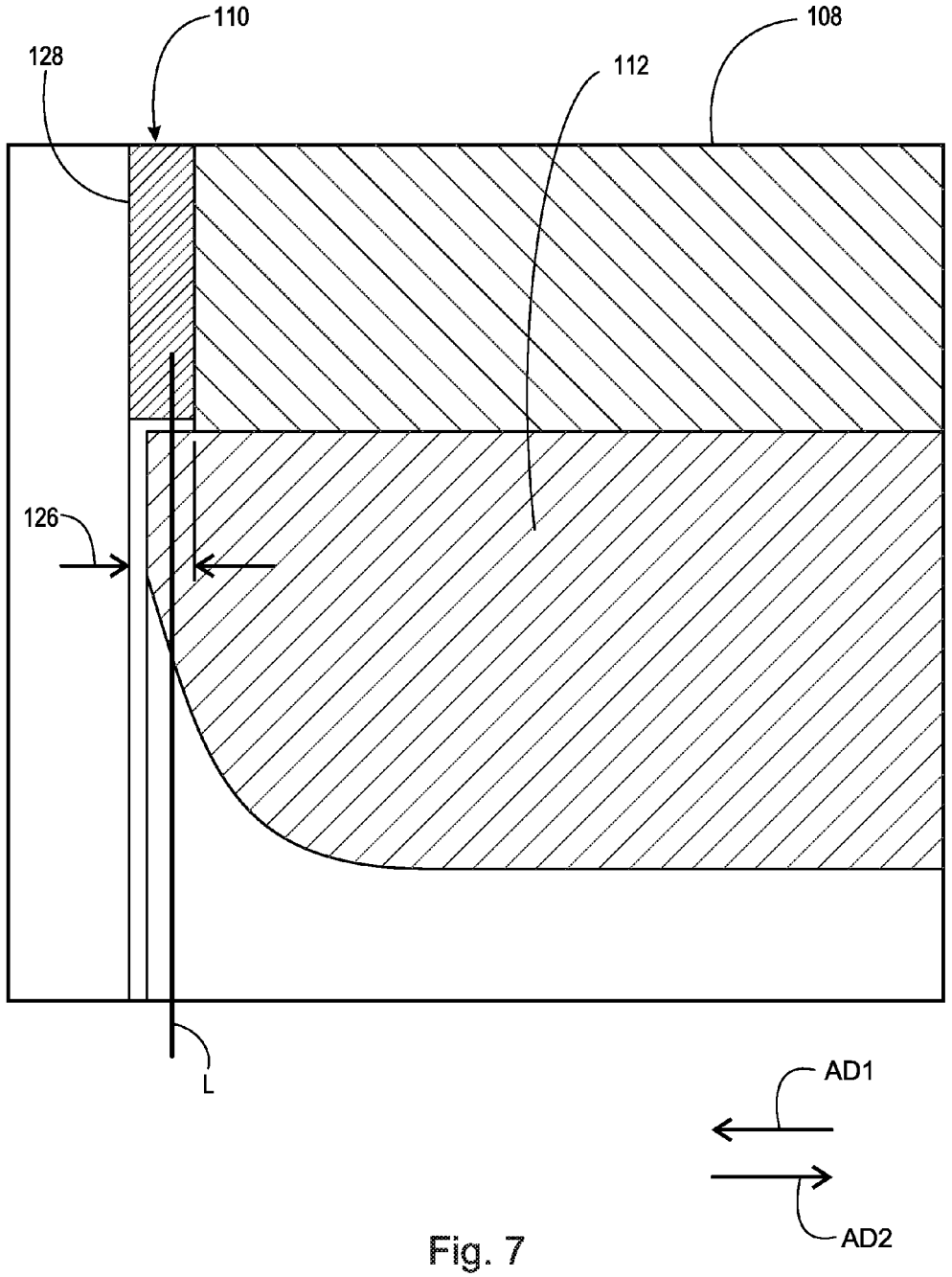
FIG. 7 is a detail of area 7 in FIG. 3.

FIG. 7 is a detail of area 7 in FIG. 3. Plate 110 extends past locking plate 108 in axial direction AD1. For example, plate 110 extends past plate 108 by overlap 126 in direction AD1. Stated otherwise, check valve plate 110 does not overlap bushing 112 in axial direction AD1. Line L, orthogonal to axis of rotation AR, passes through bushing 112 and the check valve plate 110. Plate 110 includes side 128 facing in axial direction AD1. In an example embodiment, bushing 112 does not extend to side 128 in axial direction AD1. In an example embodiment (not shown), bushing 112 extends as far as side 128 in axial direction AD1. Bore 116 is bounded by cylindrical wall 130 in locking plate 108. In an example embodiment, bushing 112 includes cylindrical outer surface 132 in contact with cylindrical wall 130.

Figure 8:
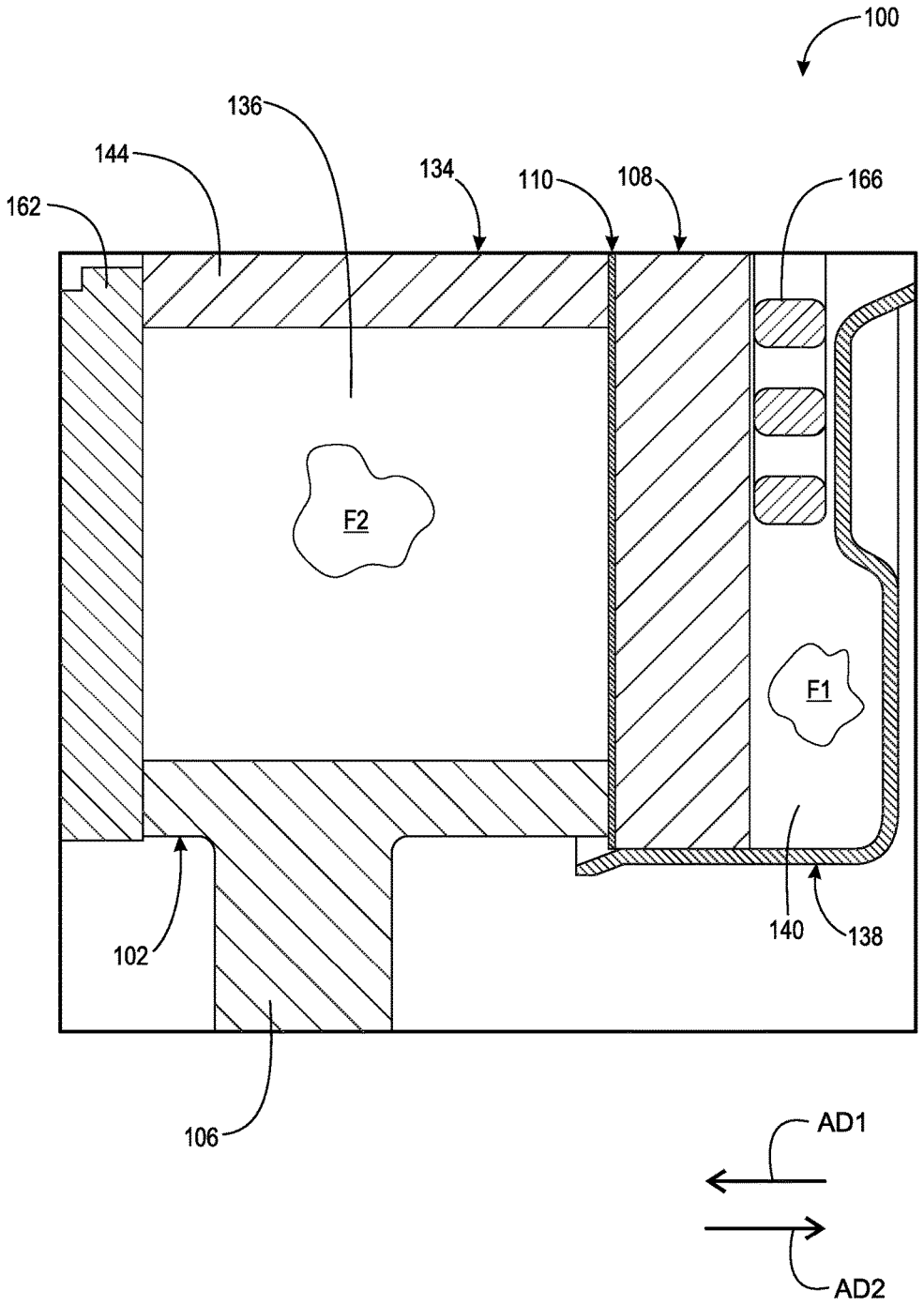
FIG. 8 is a partial cross-sectional view of the camshaft phaser in FIG. 2 through a timing chamber in the camshaft phaser.

FIG. 8 is a partial cross-sectional view of camshaft phaser 100 in FIG. 2 through a timing chamber in camshaft phaser 100. Stator 102 includes: rotor 134; chamber 136; spring cover 138 fixed to plate 108; and space 140. Chamber 136 is bounded, at least in part, by stator 102, check valve plate 110 and rotor 134. For example, phaser 100 includes eight chambers 136, each of which is circumferentially bounded by a respective radially inwardly extending vane 142 for stator 102 and a respective radially outwardly extending vane 144 for rotor 134. Space 140 is bounded, at least in part, by spring cover 138 and locking plate 108. Space 140 is in communication with through-bores 118. That is, through-bore 118 is open to space 140. Each through-bore 118 has a respective flap 124.

For fluid pressure in space 140 greater than fluid pressure in a particular chamber 134, fluid F1 in space 140 is arranged to displace the flap 124 associated with the particular chamber 136 in axial direction AD1 so that the through-bore 118 associated with the particular chamber 136 is open to the chamber 136. Thus, fluid F1 flows from space 140 to the particular chamber 136. For fluid pressure in a particular chamber 136 greater than fluid pressure in space 140, fluid F2 in the particular chamber 136 is arranged to displace the flap 124 associated with the particular chamber 136 in axial direction AD2 so that the through-bore 118 associated with the particular chamber 136 is blocked by the flap 124 associated with the particular chamber 136. Thus, fluid F2 cannot flow to space 140 through the bore 118 associated with the particular chamber 136.

Figure 9:
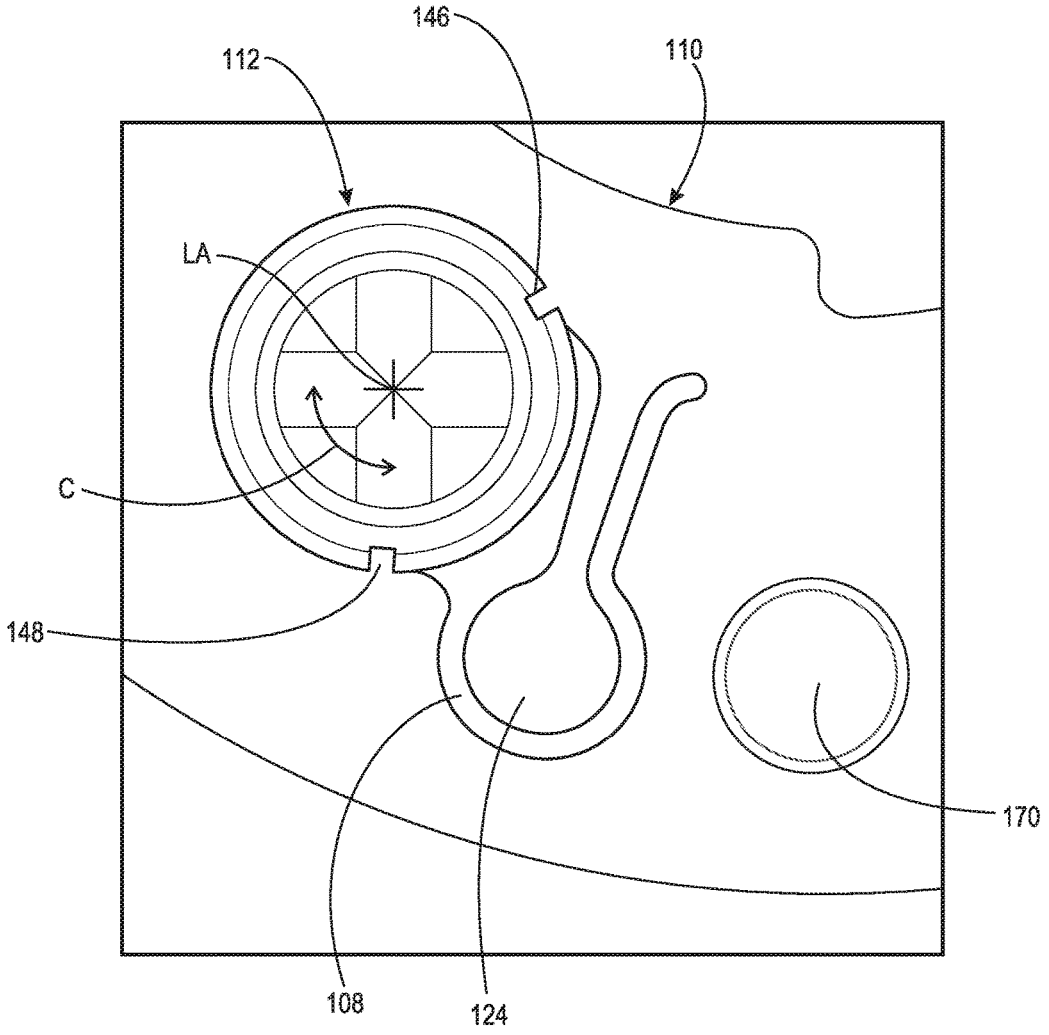
FIG. 9 is a front view of an example embodiment of the locking plate, check valve plate and bushing in FIG. 2.

FIG. 9 is a front view of an example embodiment of locking plate 108, check valve plate 110 and bushing 112 in FIG. 2.

Figure 10:
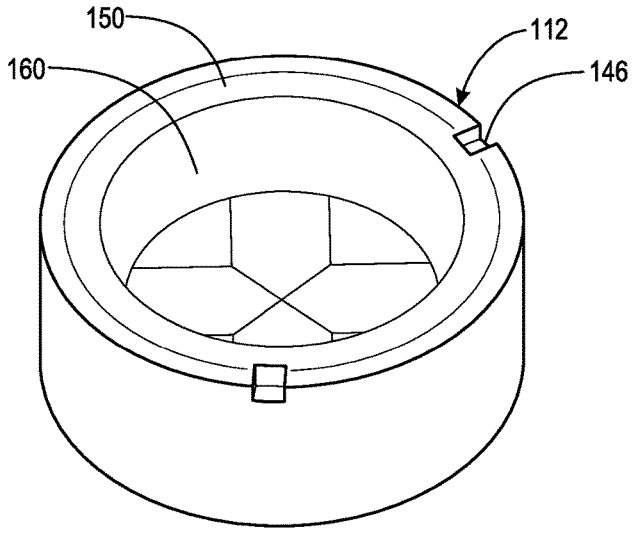
FIG. 10 is a perspective view of the bushing in FIG. 9.

FIG. 10 is a perspective view of bushing 112 in FIG. 9.

Figure 11:
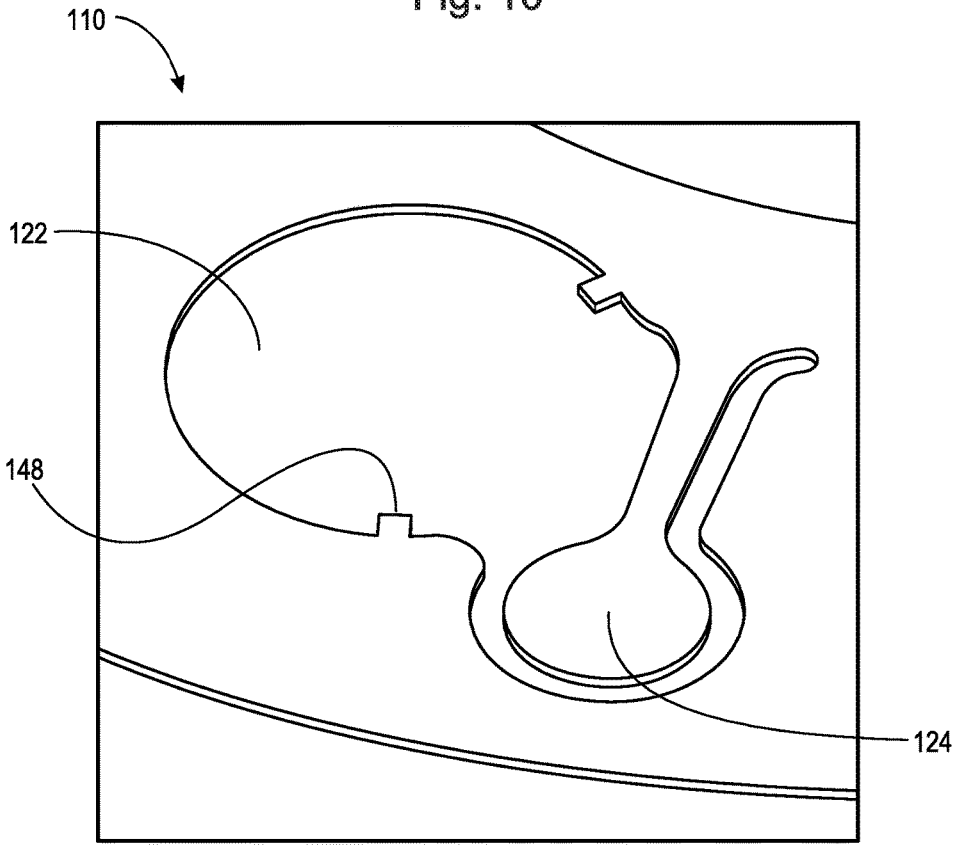
FIG. 11 is a perspective view of a portion of the check valve plate in FIG. 9.
Figure 12:
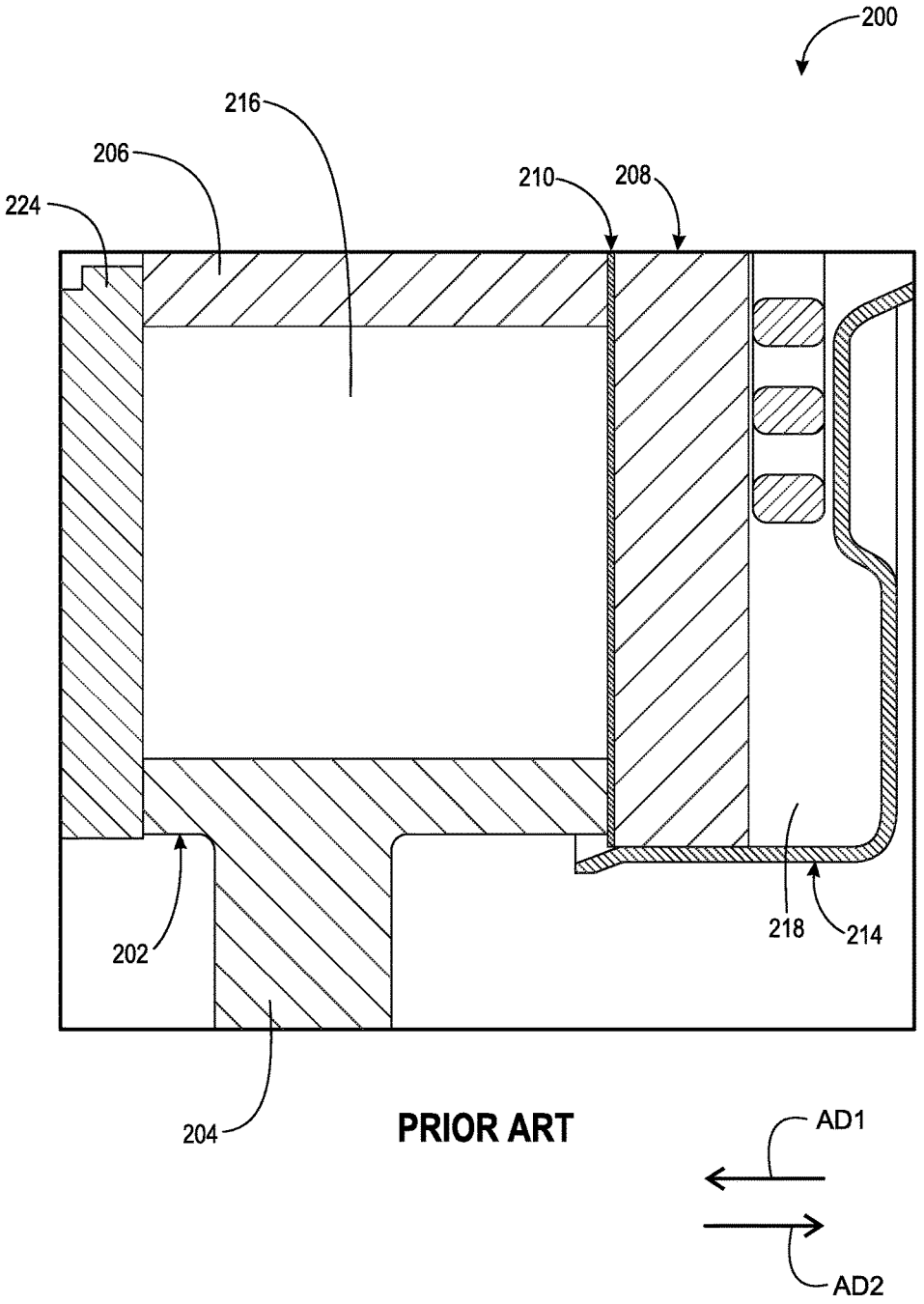
FIG. 12 is a partial cross-sectional view of a prior art camshaft phaser; and, FIG. 13 is a partial perspective view of a portion of the locking plate, check valve plate and bushing in FIG. 12.
Figure 13:
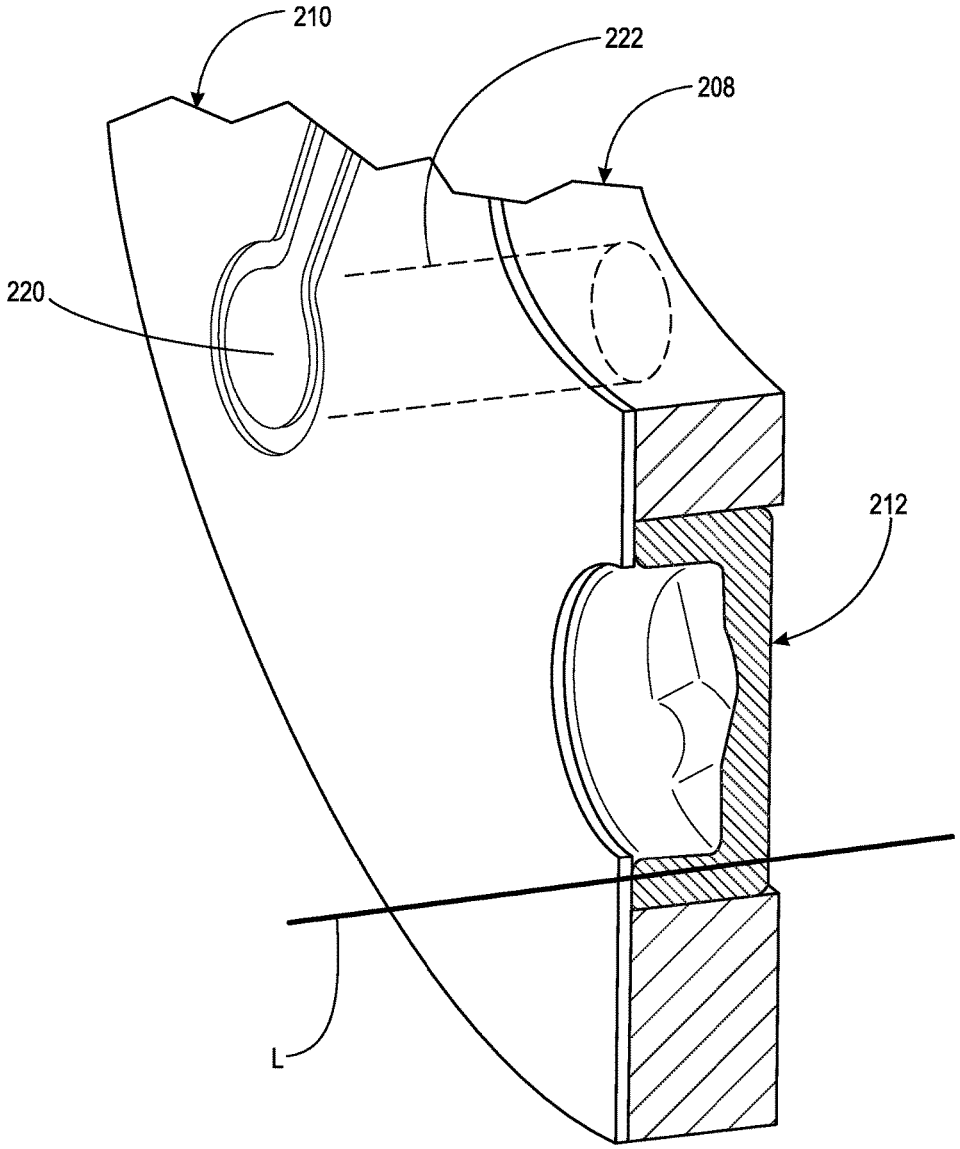
PRIOR ART Fig. 13

FIG. 11 is a perspective view of a portion of check valve plate 110 in FIG. 9. The following should be viewed in light of FIGS. 9 through 11. The discussion for FIGS. 2 through 8 is applicable to FIGS. 9 through 11 except as noted. In the example of FIGS. 9 through 11, bushing 112 includes at least one groove 146 and check valve plate 110 includes at least one tab 148 disposed in groove 146. Bushing 112 includes longitudinal axis LA extending in axial direction AD1. Because of the interlocking of tabs 148 with grooves 146, bushing 112 blocks rotation of check valve plate 110, with respect to locking plate 108, circumferentially (in directions C) about longitudinal axis LA. Bushing 112 includes axial end surface 150 facing in axial direction AD1 and groove 146 is in axial end surface 150.

In an example embodiment, rotor 134 includes through-bore 152 and phaser 100 includes locking assembly 154 in through-bore 152. Assembly 154 includes locking pin 156, cartridge 157 and spring 158. Bushing 112 includes indentation 160 facing axial direction AD1. Spring 158 is arranged to displace locking pin 156 in direction AD2 into indentation 160 to non-rotatably connect rotor 134 and stator 102. By non-rotatably connected elements, we mean that: the elements are connected so that whenever one of the elements rotates at a particular speed, all of the elements rotate at the particular speed; and relative rotation between the elements is not possible. Assembly 154 locks rotor 134 into a predetermined rotational position with respect to stator 102. To lock rotor 134 and stator 102 together, pressurized fluid flows through channel 161.

In an example embodiment, phaser 100 includes cover plate 162, fasteners 164 and spiral spring 166 in space 140. Fasteners 164 non-rotatably connect cover plate 162, stator 102, check valve plate 110 and locking plate 108. For example, fasteners 164 pass through through-bores 168 in stator 102 and through-bores 170 in plate 110 and are threaded into threaded bores 172 in plate 108.

The following should be viewed in light of FIGS. 2 through 11. The following describes a method for operating a camshaft phaser including an axis of rotation, a stator, a rotor, a locking plate, a check valve plate axially located between the locking plate and the stator, a chamber formed at least in part by the stator, the rotor and the check valve plate, and a bushing disposed in a bore in the locking plate and in a first through-bore in the check valve plate. Although the method is presented as a sequence of steps for clarity, no order should be inferred from the sequence unless explicitly stated. A first step blocks a second through-bore in the locking plate with a flap in the check valve plate. A second step displaces, in a first axial direction parallel to the axis of rotation, the flap in the check valve plate. A third step flows fluid through the second through-bore to the chamber. A fourth step displaces, in a second axial direction opposite the first axial direction, the flap in the check valve plate. A fifth step blocks, with the flap, flow of the fluid out of the chamber through the second through-bore. A sixth step blocks, with the bushing disposed in the locking plate and in the check valve plate, movement of the check valve plate with respect to the locking plate in a radial or circumferential direction as referenced by the axis of rotation. By "as referenced by the axis of rotation" we mean the axis of rotation is the point of references, for example as shown in FIGS. 1A and 1B, for the radial and circumferential directions.

In an example embodiment, blocking, with the bushing disposed in the locking plate and in the check valve plate, movement of the check valve plate with respect to the locking plate in a radial or circumferential direction as referenced by the axis of rotation includes blocking, with the bushing disposed in the locking plate and in the check valve plate, movement of the check valve plate with respect to the locking plate in the radial direction and in the circumferential direction as referenced by the axis of rotation.

In an example embodiment, a seventh step blocks, with the bushing, movement of the check valve plate, with respect to the locking plate, in a circumferential direction as referenced by a longitudinal axis extending through the bushing in an axial direction parallel to the axis of rotation. By "as referenced by the longitudinal axis" we mean the longitudinal axis is the point of references for the radial and circumferential directions.

In an example embodiment: displacing, in a first axial direction parallel to the axis of rotation, the flap in the check valve plate includes fluid pressure in a space formed at least in part by a spring cover fixed to the locking plate and the locking plate being greater than fluid pressure in the chamber; flowing fluid through the through-bore to the chamber includes flowing fluid from the space; and displacing, in the second axial direction, the flap in the check valve plate includes fluid pressure in chamber being greater than fluid pressure in the space.

In an example embodiment, an eighth step displaces a pin, disposed in part in the rotor, into an indentation in the bushing, and a ninth step non-rotatably connects the stator and the rotor.

Advantageously, camshaft phaser 100 and the method described above solve the problem noted above with respect to fixing a position of plate 110 during assembly of phaser 100. For example, bushing 112 as shown in FIGS. 2 through 8 fixes, with respect to the locking plate, a position of the check valve plate with respect to movement in circumferential directions CD1 and CD2 and in radial directions RD1 and RD2. In addition, bushing 112 as shown in FIGS. 9 through 11, prevents swiveling of bushing 112 in direction C about longitudinal axis LA for bushing 112. Thus, the correct positioning of plate 110 is ensured during assembly of phaser 100 and the need for additional time and cost increasing measures in eliminated.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

The invention claimed is:

1. A camshaft phaser, comprising:
- an axis of rotation;
- a stator including a radially outermost surface with a plurality of teeth;
- a locking plate including:
  - a first side facing in a first axial direction;
  - a bore in the first side; and,
  - a first through-bore;
- a check valve plate axially located between the locking plate and the stator and including:
  - a second through-bore; and,
  - a displaceable valve flap aligned, in the first axial direction, with the first through-bore; and,
- a bushing:
  - disposed in:
    - the bore in the first side; and,
    - the second through-bore; and,
  - extending past the locking plate in the first axial direction.

2. The camshaft phaser of claim 1, wherein a line orthogonal to the axis of rotation passes through the bushing and the check valve plate.

3. The camshaft phaser of claim 1, wherein:
- the check valve plate includes a first side facing in the first axial direction; and,
- the bushing does not extend past the first side in the first axial direction.

4. The camshaft phaser of claim 1, wherein the check valve plate does not overlap the bushing in the first axial direction.

5. The camshaft phaser of claim 1, wherein:
the bore in the first side is bounded by a cylindrical wall in the locking plate; and,
the bushing includes a cylindrical outer surface in contact with the cylindrical wall.

6. The camshaft phaser of claim 1, further comprising:
a rotor;
at least one chamber bounded, at least in part, by the stator, the check valve plate and the rotor;
a spring cover; and,
a space bounded, at least in part, by the spring cover and the locking plate and in communication with the first through-bore, wherein:
for fluid pressure in the space greater than fluid pressure in the at least one chamber, fluid in the space is arranged to displace the valve flap in the first axial direction so that the first through-bore in the locking plate is open to the at least one chamber; and,
for fluid pressure in the at least one chamber greater than fluid pressure in the space, fluid in the at least one chamber is arranged to displace the valve flap in a second axial direction so that the first through-bore is blocked by the valve flap.

7. The camshaft phaser of claim 1, wherein the bushing fixes, with respect to the locking plate, a position of the check valve plate with respect to movement in:
a circumferential direction only; or,
a radial direction only.

8. The camshaft phaser of claim 1, wherein:
the bushing includes at least one groove; and,
the check valve plate includes at least one tab disposed in the at least one groove.

9. The camshaft phaser of claim 8, wherein:
the bushing includes a longitudinal axis extending in the first axial direction; and,
the bushing blocks rotation of the check valve plate, with respect to the locking plate, circumferentially about the longitudinal axis.

10. The camshaft phaser of claim 8, wherein:
the bushing includes an axial end surface facing in the first axial direction; and,
the at least one groove is in the axial end surface.

11. The camshaft phaser of claim 1, wherein the stator includes a radially inwardly extending vane, the camshaft phaser further comprising:
a rotor including a radially outwardly extending vane;
a third through-bore in the radially outwardly extending vane of the rotor; and,
a locking assembly including a locking pin and a spring disposed in the third through-bore; wherein:
the bushing includes an indentation facing the first axial direction; and,
the spring is arranged to displace the locking pin into the indentation to non-rotatably connect the rotor and the stator.

12. A camshaft phaser, comprising:
an axis of rotation;
a stator including a radially outermost surface with a plurality of teeth;
a locking plate including:
a first side facing in a first axial direction;
a bore in the first side; and,
a first through-bore;
a check valve plate axially located between the locking plate and the stator and including:
a second through-bore; and,
a displaceable valve flap aligned, in the first axial direction, with the first through-bore; and,
a bushing:
including a longitudinal axis extending in the first axial direction;
disposed in:
the bore in the first side; and,
the second through-bore; and,
blocking movement of the check valve plate, with respect to the locking plate, in:
a radial direction with respect to the longitudinal axis; or,
a circumferential direction with respect to the longitudinal axis.

13. The camshaft phaser of claim 12, wherein:
a line orthogonal to the axis of rotation passes through the bushing and the check valve plate; or,
the check valve plate does not overlap the bushing in the first axial direction.

14. The camshaft phaser of claim 12, further comprising:
a rotor;
at least one chamber bounded, at least in part, by the stator, the check valve plate and the rotor;
a spring cover; and,
a space bounded, at least in part, by the spring cover and the locking plate and in communication with the first through-bore, wherein:
for fluid pressure in the space greater than fluid pressure in the at least one chamber, fluid in the space is arranged to displace the valve flap in the first axial direction so that the first through-bore is open to the at least one chamber; and,
for fluid pressure in the at least one chamber greater than fluid pressure in the space, fluid in the at least one chamber is arranged to displace the valve flap in a second axial direction so that the first through-bore is blocked by the valve flap.

15. The camshaft phaser of claim 12, wherein:
the bushing includes at least one groove; and,
the check valve plate includes at least one tab disposed in the at least one groove.

16. A method of operating a camshaft phaser including an axis of rotation, a stator, a rotor, a locking plate, a check valve plate axially located between the locking plate and the stator, a chamber formed at least in part by the stator, the rotor and the check valve plate, and a bushing disposed in a bore in the locking plate and in a first through-bore in the check valve plate, the method comprising:
blocking a second through-bore in the locking plate with a flap in the check valve plate;
displacing, in a first axial direction parallel to the axis of rotation, the flap in the check valve plate;
flowing fluid through the second through-bore to the chamber;
displacing, in a second axial direction opposite the first axial direction, the flap in the check valve plate;
blocking, with the flap, flow of the fluid from the chamber through the second through-bore; and,
blocking, with the bushing, movement of the check valve plate with respect to the locking plate in a radial or a circumferential direction as referenced by the axis of rotation.

17. The method of claim 16, wherein blocking, with the bushing, movement of the check valve plate with respect to the locking plate in a radial or a circumferential direction as referenced by the axis of rotation includes blocking, with the bushing, movement of the check valve plate with respect to the locking plate in the radial direction and in the circumferential direction as referenced by the axis of rotation.

18. The method of claim 16, further comprising:

blocking, with the bushing, movement of the check valve plate, with respect to the locking plate, in a circumferential direction as referenced by a longitudinal axis extending through the bushing in an axial direction parallel to the axis of rotation.

19. The method of claim 16, wherein:

displacing, in a first axial direction parallel to the axis of rotation, the flap in the check valve plate includes fluid pressure in a space formed at least in part by a spring cover fixed to the locking plate and the locking plate being greater than fluid pressure in the chamber;

flowing fluid through the through-bore to the chamber includes flowing fluid from the space; and, displacing, in the second axial direction, the flap in the check valve plate includes fluid pressure in the chamber being greater than fluid pressure in the space.

20. The method of claim 16, further comprising:

displacing a pin, disposed in part in the rotor, into an indentation in the bushing; and, non-rotatably connecting the stator and the rotor.

* * * * *